US011406985B2

(12) United States Patent
Sproule

(10) Patent No.: US 11,406,985 B2
(45) Date of Patent: Aug. 9, 2022

(54) CLAMPING TOOL FOR A JAW CRUSHER

(71) Applicant: Terex GB Limited, Dungannon (GB)

(72) Inventor: Phillip Sproule, Omagh (GB)

( * ) Notice: Subject to any disclaimer, the term of this patent is extended or adjusted under 35 U.S.C. 154(b) by 250 days.

(21) Appl. No.: 16/520,603

(22) Filed: Jul. 24, 2019

(65) Prior Publication Data

US 2020/0030808 A1 Jan. 30, 2020

(30) Foreign Application Priority Data

Jul. 27, 2018 (GB) ..... 1812319

(51) Int. Cl.
*B02C 1/10* (2006.01)
*B02C 1/04* (2006.01)

(52) U.S. Cl.
CPC ..... *B02C 1/10* (2013.01); *B02C 1/04* (2013.01); *B02C 2210/02* (2013.01)

(58) Field of Classification Search
CPC .... B02C 1/00; B02C 1/02; B02C 1/04; B02C 1/043; B02C 1/06; B02C 1/10
See application file for complete search history.

(56) References Cited

U.S. PATENT DOCUMENTS 2,453,596 A 11/1948 Roubal
2,465,607 A * 3/1949 Roubal ..... B02C 1/10 241/300
3,153,512 A * 10/1964 Polzin ..... B02C 1/10 241/300
3,804,345 A * 4/1974 DeDiemar ..... B02C 1/04 241/264
7,341,213 B2 3/2008 Boast
8,033,489 B2 10/2011 Boast
8,091,818 B2 1/2012 Stemper
8,162,245 B2 4/2012 Sauser et al.
8,403,244 B2 3/2013 Young et al.
8,469,298 B2 6/2013 Robinson et al.
8,905,338 B2 12/2014 Robinson et al.
9,421,547 B2 8/2016 Boast et al.
9,486,804 B2 11/2016 Boast et al.
10,137,457 B2 11/2018 Robinson et al.
(Continued)

FOREIGN PATENT DOCUMENTS

DE 800292 C 10/1950
EP 2674218 A1 12/2013
(Continued)

OTHER PUBLICATIONS

Search Report dated Jan. 14, 2019, for United Kingdom application No. GB1812319.0.
(Continued)

*Primary Examiner* — Matthew Katcoff
(74) *Attorney, Agent, or Firm* — Warner Norcross + Judd LLP

(57) ABSTRACT

A jaw crusher assembly comprises a jaw crusher a jaw liner clamping tool for clamping a jaw liner to a jaw of the jaw crusher. The clamping tool comprises a clamping head pivotably coupled to a shaft, and a releasable fastening mechanism. The shaft passes through the jaw and its free end is fastened to the jaw by the fastening mechanism, which is tightened to cause the clamping head to exert a clamping force to hold the jaw liner in place. The clamping tool facilitates safe installation of the jaw liners.

19 Claims, 5 Drawing Sheets

(56) References Cited

U.S. PATENT DOCUMENTS

| | | | | |
|---|---|---|---|---|
| 2010/0044486 | A1 | 2/2010 | Holmes | |
| 2015/0174580 | A1* | 6/2015 | Lindberg | B02C 1/10 241/300 |
| 2020/0023370 | A1* | 1/2020 | Lindberg | B02C 1/10 |

FOREIGN PATENT DOCUMENTS

| | | | |
|---|---|---|---|
| EP | 2674219 | A1 | 12/2013 |
| JP | 2009214199 | A | 9/2009 |

OTHER PUBLICATIONS

European Search Report, dated Nov. 13, 2019, for EP patent application EP19187055, a foreign counterpart.

* cited by examiner

CLAMPING TOOL FOR A JAW CRUSHER

FIELD OF THE INVENTION

This invention relates to jaw crushers. The invention relates particularly to clamping tools for jaw crushers.

BACKGROUND TO THE INVENTION

Jaw crushers are well known in the material processing industry and are commonly used for crushing rocks. Jaw crushers typically include a movable jaw and a fixed jaw, at least one of which has a removable jaw liner that is replaced when worn. Jaw liners are fitted to the jaw and held in place by locking wedges. Both the jaw liners and the wedges are large and heavy, and their installation and replacement usually involves the use of lifting equipment.

A problem associated with fitting a jaw liner to a jaw is how to hold the jaw liner in place while the wedges are being fitted. A conventional solution to this problem is to install a prop between the jaws until the wedges are in place. However, this solution is considered to be unsafe.

It would be desirable therefore to provide an improved device for use during the installation of jaw liners.

SUMMARY OF THE INVENTION

A first aspect of the invention provides a jaw crusher assembly comprising:

- a jaw crusher having first and second jaws, at least one of said jaws having a jaw liner; and a jaw liner clamping tool comprising:
  - a shaft;
  - a clamping head coupled to the shaft, the clamping head comprising a first clamping portion having a clamping surface; and
- a releasable fastening mechanism, wherein clamping tool is coupled to said at least one jaw by said shaft and said fastening mechanism, with said clamping surface engaging said jaw liner to releasably clamp said jaw liner to said at least one jaw.

The jaw liner typically has a crushing surface, said clamping surface preferably engaging with said crushing surface. The clamping surface may engage with an edge of said crushing surface.

The crushing surface may comprise a plurality of parallel ridges, the clamping surface of said first clamping portion advantageously being shaped and dimensioned to engage with at least two of said ridges. In preferred embodiments, the clamping surface has a width that is at least equal to, and preferably greater than, the pitch between adjacent ridges of the crushing surface.

Advantageously, the clamping surface of said first clamping portion engages with the respective crest of said at least two ridges.

Preferably, the clamping surface of said first clamping portion is substantially planar.

In preferred embodiments, said shaft projects from an underside of said clamping head, said clamping surface being provided on the underside of said clamping head.

In preferred embodiments, said clamping head comprises a plate.

Preferably, the clamping head comprises a second clamping portion having a clamping surface engaging with the jaw to which said jaw liner is fitted, said shaft preferably being located between said first and second clamping portions. Said clamping surface of said second clamping portion is conveniently provided on the underside of said clamping head. Preferably, said clamping surface of said second portion is provided by a flange provided on said clamping head, preferably projecting from the underside of the clamping head.

In preferred embodiments the clamping head is pivotably coupled to the shaft for pivoting movement about a pivot axis. The clamping head preferably comprises first and second clamping portions on opposite sides of the pivot axis. The shaft may pass through a slot formed in the clamping head, and is coupled to said clamping head by a pivot joint, and wherein said pivot joint is preferably provided on an obverse side of the head.

In preferred embodiments, the fastening mechanism is adjustable to allow the clamping tool to be tightened to exert a clamping force. The fastening mechanism may be coupled to the shaft, preferably to an end of the shaft, or otherwise at a location distal the clamping head. Conveniently, the fastening mechanism comprises at least one nut mounted on a threaded portion of said shaft.

Typically, said at least one of said first and second jaws comprises a jawstock to which said jaw liner is fitted, said clamping tool engaging with said jawstock and said jaw liner to clamp said jaw liner to said jawstock. The preferred configuration is such that the first clamping portion has a clamping surface in engagement with a crushing surface of said jaw liner, preferably with an edge of said crushing surface, and said second clamping portion has a clamping surface in engagement with said jawstock. In typical embodiments, a wedge-receiving recess is defined between an end of said jaw liner and a portion of said jawstock, said clamping head extending over said recess.

Typically, the jawstock includes at least one socket, said shaft of said clamping tool being inserted in one of said at least one socket. The or each socket typically opens onto the wedge-receiving recess.

A free end of the shaft conveniently projects from said socket, and wherein said fastening mechanism fastens said free end of said shaft to said jawstock.

From another aspect the invention provides a jaw liner clamping tool for a jaw crusher, the clamping tool comprising:

- a shaft;
- a clamping head coupled to the shaft, the clamping head comprising a first clamping portion having a clamping surface; and
- a releasable fastening mechanism wherein said shaft and said fastening mechanism are configured for coupling said clamping tool to said jaw so that said clamping surface engages said jaw liner to releasably clamp said jaw liner to said at least one jaw.

From a further aspect the invention provides a jaw liner clamping tool for a jaw crusher, the clamping tool comprising:

- a shaft;
- a clamping head pivotably coupled to the shaft for pivoting movement about a pivot axis; and
- a fastening mechanism, wherein said clamping head comprises first and second clamping portions on opposite sides of the pivot axis.

Further advantageous aspects of the invention will be apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which.

DETAILED DESCRIPTION OF THE DRAWINGS

Figure 1:
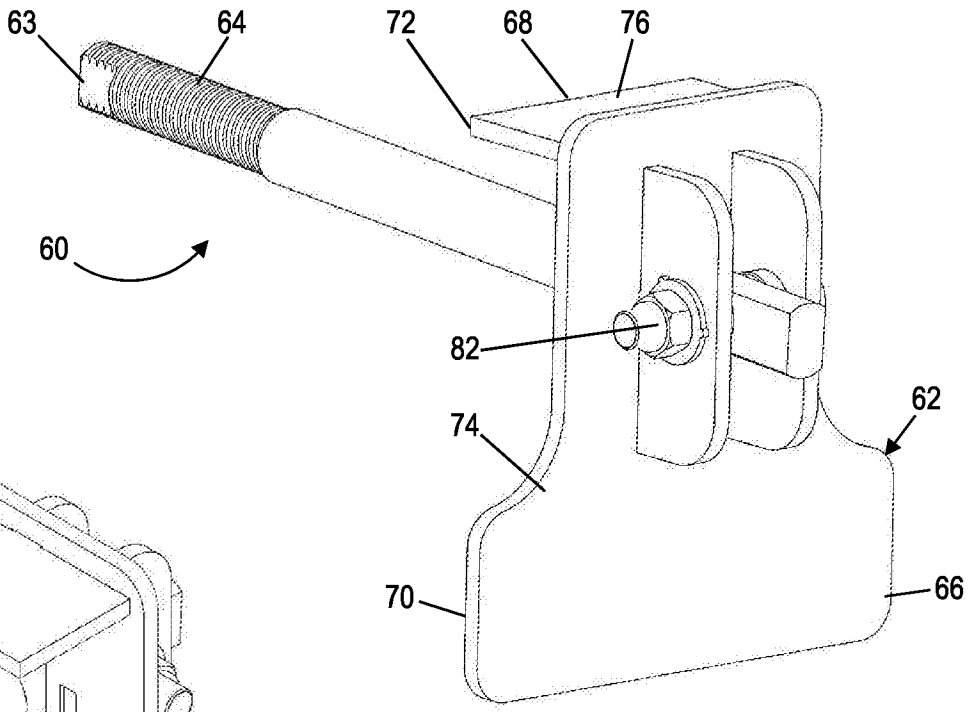
FIG. 1 is a first perspective view of a jaw liner clamping tool embodying one aspect of the invention.

Referring in particular to FIGS. 3 to 7 of the drawings there is shown a jaw crusher, generally indicated as 10. The jaw crusher 10 is of a general type commonly used in material processing operations to crush rocks or other crushable material. Typically, the crusher 10 is installed on a material processing apparatus (not shown), which includes other components that co-operate directly or indirectly with the crusher 10, for example conveyor(s), feeder(s), hopper(s) and/or screen(s), all of which may be mounted on a chassis (with wheel(s) and/or track(s)) or other base.

The jaw crusher 10 comprises first and second opposed crushing jaws 12, 14, at least one of which is movable with respect to the other to enable the jaws 12, 14 in order to crush material between the jaws 12, 14. In typical embodiments, the first jaw 12 is fixed and the second jaw 14 is movable towards and away from the first jaw 12 in an oscillatory manner.

A drive system is provided for moving the, or each, movable jaw. Typically the drive system comprises a rotatable wheel 16 (typically a fly wheel) coupled to an eccentric shaft 18, the shaft 18 being coupled to one end of the movable jaw 14. The movable jaw 14 is also coupled to a toggle mechanism 20, which typically includes a toggle plate 22 and a tensioning rod and spring or ram assembly 24. A motor (not shown) is coupled to the wheel 16, for example by a drive belt (not shown), for the rotation thereof. In use, the motor rotates the wheel 16 causing the upper end of the jaw 14 to oscillate, while the toggle mechanism 20 causes or facilitates oscillatory movement of the lower end of the jaw 14.

Typically, side walls 26 (only one shown) are provided beside the jaws 12, 14 to form, together with the jaws 12, 14, a crushing chamber. All of the crusher components may be provided on any suitable base (not shown).

Each jaw 12, 14 comprises a base 28, 30, which may be referred to as a jawstock, and a jaw liner 32, 34. Each jaw liner 32, 34 has a crushing surface 36, 38, the respective crushing surfaces 36, 38 opposing one another so that material can be crushed therebetween. The crushing surface 36, 38 may be fluted, comprising a plurality of parallel ridges 40. Each ridge 40 typically extends in a top-to-bottom direction of the jaw liner 32, 34. The jaw liners 32, 34 are typically plate-like in form (and may be referred to as jaw plates). The crushing surfaces 36, 38 are typically rectangular. Each jaw liner 32, 34 is removable from the respective jawstock 28, 30 to allow it to be replaced, for example in the event that it becomes overly worn through use.

In the illustrated embodiment, each of the jaw liners 32, 34 is removable. In alternative embodiments, only one of the jaw liners may be removable. Alternatively still, one of the crushing surfaces may be integrally formed with the respective jawstock rather than being formed on a jaw liner.

The jaw liners 32, 34 are secured in place on the respective jawstock 28, 30 by one or more locking wedges 42, 44. The locking wedges 42, 44 are shaped and dimensioned to be wedged between the respective jaw liner 32, 34 and jawstock 28, 30 in order to hold the liner in place. To this end, the jawstock 28, 30 may be shaped to define a recess 46, 48 adjacent the jaw liner 32, 34 (when fitted) into which the locking wedge 42, 44, may be wedged. Each locking wedge 42, 44 typically includes at least one shaft 50, typically in the form of a bolt, for use in securing the wedge 42, 44 to the jawstock 28, 30. The jawstock 28, 30 includes a respective socket 54, 56 for receiving each shaft 50 such that a free end of the shaft 50 protrudes from the socket 54, 56 at an opposite end of the socket to the wedge 42, 44. One or more nut 58 or other fastener is fitted to the free end of the shaft 50 to secure the wedge 42, 44 to the jawstock 28, 30. The respective sockets 54, 56 associated with each liner 32, 34 are conveniently spaced apart, typically linearly, along the respective jawstock 28, 30 adjacent an edge (in this case the top) of the respective liner 32, 34 when present. The sockets 54, 56 are typically located in (i.e. open into) the recess 46, 48 provided for the wedge 42, 44.

In the illustrated embodiment, each jaw 12, 14 is configured to use two wedges 42, 44 (only one shown per jaw 12, 14) for securing its liner 32, 34 to its jawstock 28, 30, the respective two wedges 42, 44 being located side by side along the top of the respective jaw liner 32, 34. In alternative embodiments, there may be only one wedge per jaw liner, or more than two wedges per jaw liner, one or more wedge being located along the top of the jaw liner and/or along the bottom of the jaw liner. In any event, it is preferred that the wedges, when fitted, do not protrude beyond the respective crushing surface 36, 38.

In the illustrated embodiment, each wedge 42, 44 has two shafts 50. Alternatively, each wedge 42, 44 may have one shaft or more than two shafts. In the present example, assuming that there are two wedges per liner, each wedge having two shafts, there are four sockets 54, 56 in each jawstock for receiving the shafts 50.

Figure 2:
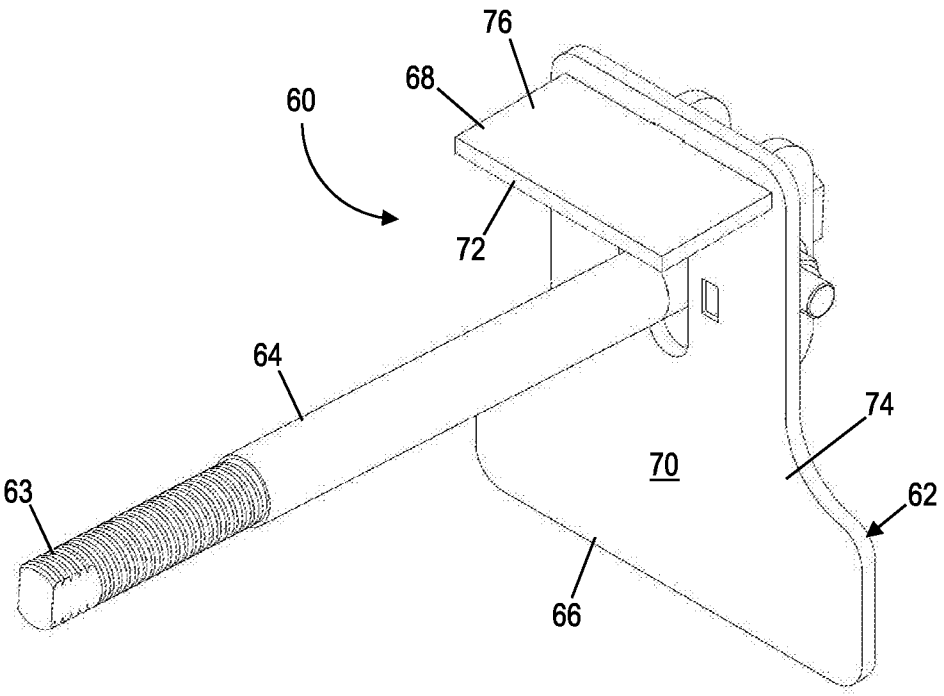
FIG. 2 is an alternative perspective view of the jaw liner clamping tool of FIG. 1.

Referring now in particular to FIGS. 1 and 2, there is shown a preferred embodiment of a clamping tool 60 for holding jaw liners in place while the locking wedges 42, 44 are fitted. The clamping tool 60 comprises a clamping head 62 pivotably coupled to a shaft 64, conveniently at an end of the shaft 64. In alternative embodiments (not illustrated), the clamping head 62 may be fixed, i.e. non-pivoting, with respect to the shaft 64. The preferred clamping head 62 has first and second clamping portions 66, 68. In preferred embodiments, the shaft 64 is pivotably coupled to the head 62 at a location between the clamping portions 66, 68 to provide a pivot axis that is located between the clamping portions 66, 68. As such, the clamping head 62 is capable of pivoting with respect to the shaft 64 in a levered, or seesaw, manner. In alternative embodiments where the head 62 is fixed with respect to the shaft 64, the shaft 64 may be fixed to the head 62 at a location between the clamping portions 66, 68 (by any suitable means, e.g. welding).

The first clamping portion 66 has a clamping surface 70 for engaging with any one of the jaw liners 32, 34, preferably with the respective crushing surface 36, 38. In preferred embodiments, the clamping surface 70 has a width that is at least equal to, and preferably greater than, the pitch between adjacent ridges 40 of the crushing surface 36, 38. For example, the width of the clamping surface 70 may be at least twice the pitch between adjacent ridges 40. The clamping surface 70 is preferably substantially planar. In preferred embodiments, the width of the clamping surface 70 is typically the dimension in a direction parallel with the pivot axis. More generally, the clamping surface 70 is dimensioned to engage with at least two of said ridges, typically at least two adjacent ridges.

The second clamping portion 68 has a clamping surface 72 for engaging with the jawstock 28, 30 to which the relevant jaw liner 32, 34 is fitted.

In preferred embodiments, the respective clamping surfaces 70, 72 are located on the underside of the clamping head 62. The shaft 64 projects from the underside and has a free end 63, or other portion, that is adapted, e.g. threaded, to receive a nut 65, washer and/or other fastener(s). The end 63 may be adapted to be gripped by a tool (not shown) such as a spanner to help a user to position, e.g. rotate, the clamping tool 62 if required. In the illustrated example, the end 63 is provided with oppositely disposed flat portions for this purpose.

In preferred embodiments, the clamping head 62 comprises a plate 74. The plate is preferably pivotably coupled to the shaft 64. The plate 74 provides at least part of the clamping portions 66, 68 on either side of the pivot axis. The underside of the first clamping portion 66 of plate 74 provides the clamping surface 70. Optionally (although not in the illustrated embodiment), the underside of the second clamping portion 68 of plate 74 provides the clamping surface 72.

In preferred embodiments, a flange 76 is provided on the underside of the clamping head 62, the flange 76 providing the clamping surface 72. The flange 76 projects, preferably substantially perpendicularly, from the underside of the clamping head 62, i.e. from the underside of the plate 74 in preferred embodiments. The clamping surface 72 may be provided by an edge of the flange 76, the edge preferably running substantially parallel with the underside of the clamping head 62 or plate 74.

The pivotable coupling between the head 62 and the shaft 64 may take any conventional form. For example, the shaft 64 may pass through a slot 80 formed in the clamping head 62, and a pivot joint 82, typically a single axis pivot joint, may couple the shaft 64 to the head 62. The slot 80 is long enough to allow the head 62 to pivot with respect to the shaft 64. It is preferred that the pivot joint 82 is provided on the opposite side of the head 62 to the underside.

Referring in particular to FIGS. 3, 4, 5 and 6, a preferred jaw liner installation method is described. The method is described by way of example in the context of fitting the jaw liner 32 to jaw 12, and assumes that there are two locking wedges 42 for the liner 32. It will be understood that the same or similar description may apply to the jaw liner 34 and jaw 14, and to other variations including those contemplated herein.

Figure 3:
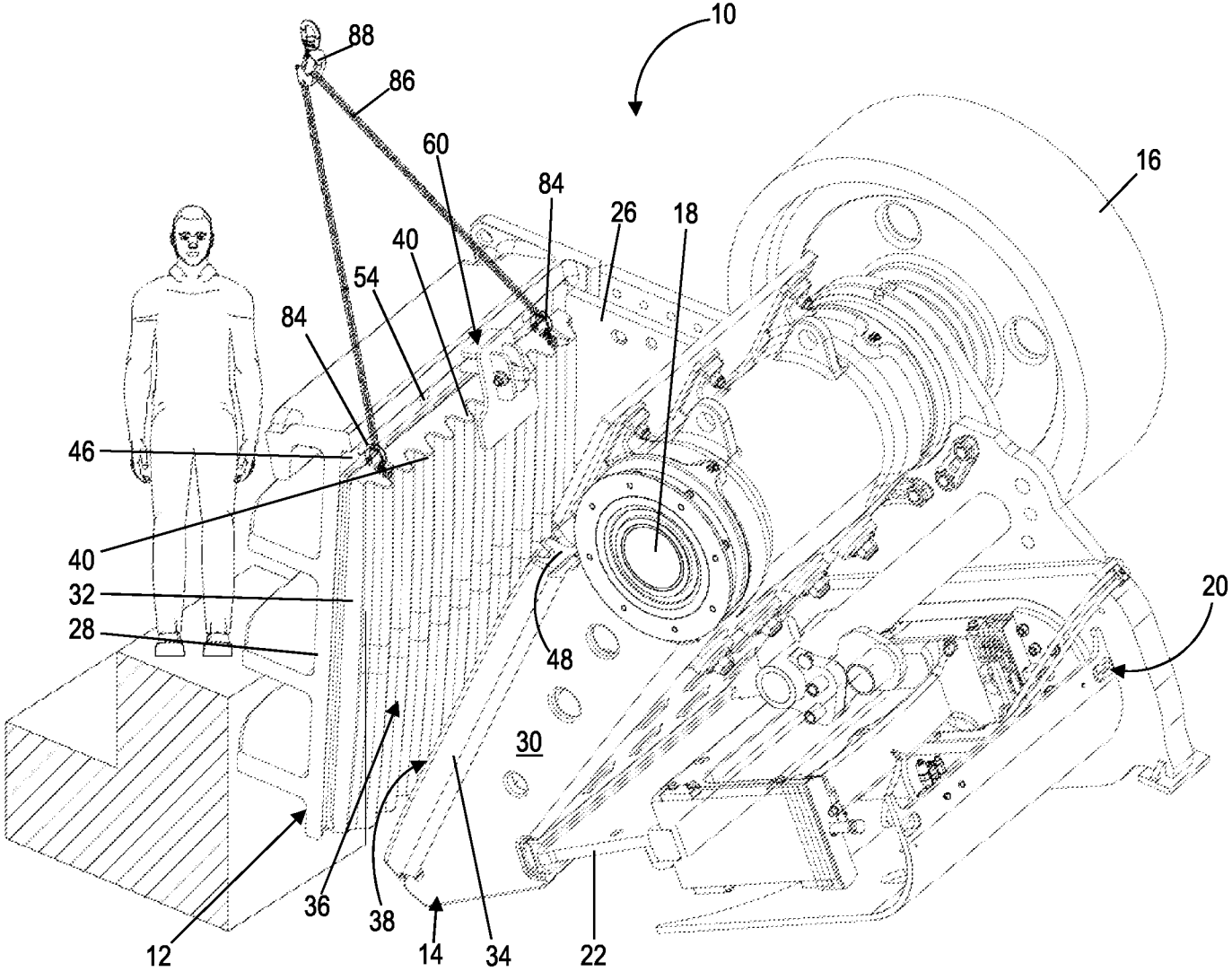
FIG. 3 is a perspective view of a jaw crusher including the clamping tool of FIG. 1 holding a jaw liner in place.

With the clamping tool 60 removed, the jaw liner 32 is lifted into place on the jawstock 28. Typically this involves the use of mechanical lifting equipment (e.g. a hoist or crane), which is represented in FIG. 3 by shackles 84, chain 86 and hook 88. While the jaw liner 32 is still supported by the lifting equipment, the clamping tool 60 is fitted to secure the jaw liner 32 in place on the jawstock 28. The clamping tool 60 is fitted by inserting the shaft 64 through a socket in the jawstock 28, the shaft 64 being shaped and dimensioned such that the free end 63 of the shaft 64 protrudes from the socket at an opposite end of the socket (and on an opposite side of the jawstock 28) to the end where the clamping head 62 is located. Conveniently the shaft 64 is inserted though one of the sockets 54 provided for a shaft 50 of one of the respective wedges 42. In alternative embodiments, a dedicated socket for the shaft 64 may be provided. One or more nut 65 or other fastener(s) is fitted to the end 63 of the shaft 64 to secure the clamping tool 60, and therefore the jaw liner 32, in place. In the illustrated embodiment, nut 65 is threaded onto the threaded portion of shaft 64 and tightened to cause the clamping tool 60 to hold the jaw liner 32 in place. In alternative embodiments, any suitable releasable fastening mechanism may be provided for securing the clamping tool 60 with respect to the jawstock 28, the fastening mechanism preferably being adjustable to allow the clamping tool to be tensioned or otherwise tightened to exert a clamping force to hold the jaw liner in place. The fastening mechanism (e.g. the nut 65 and any associated washer(s)) is typically coupled to the shaft 64, preferably to the end 63 of the shaft, or otherwise distal the clamping head 62.

Figure 5:
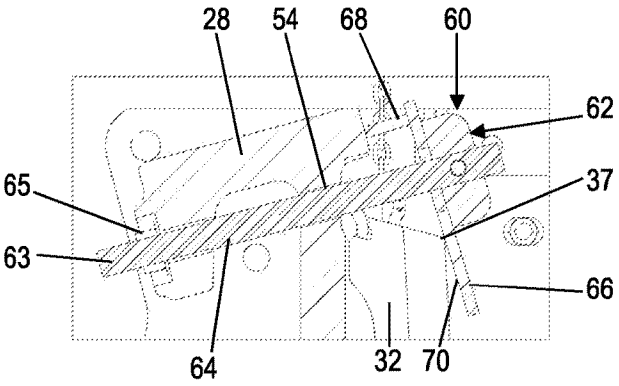
FIG. 5 is a detail of the clamping tool in FIG. 4.
Figure 4:
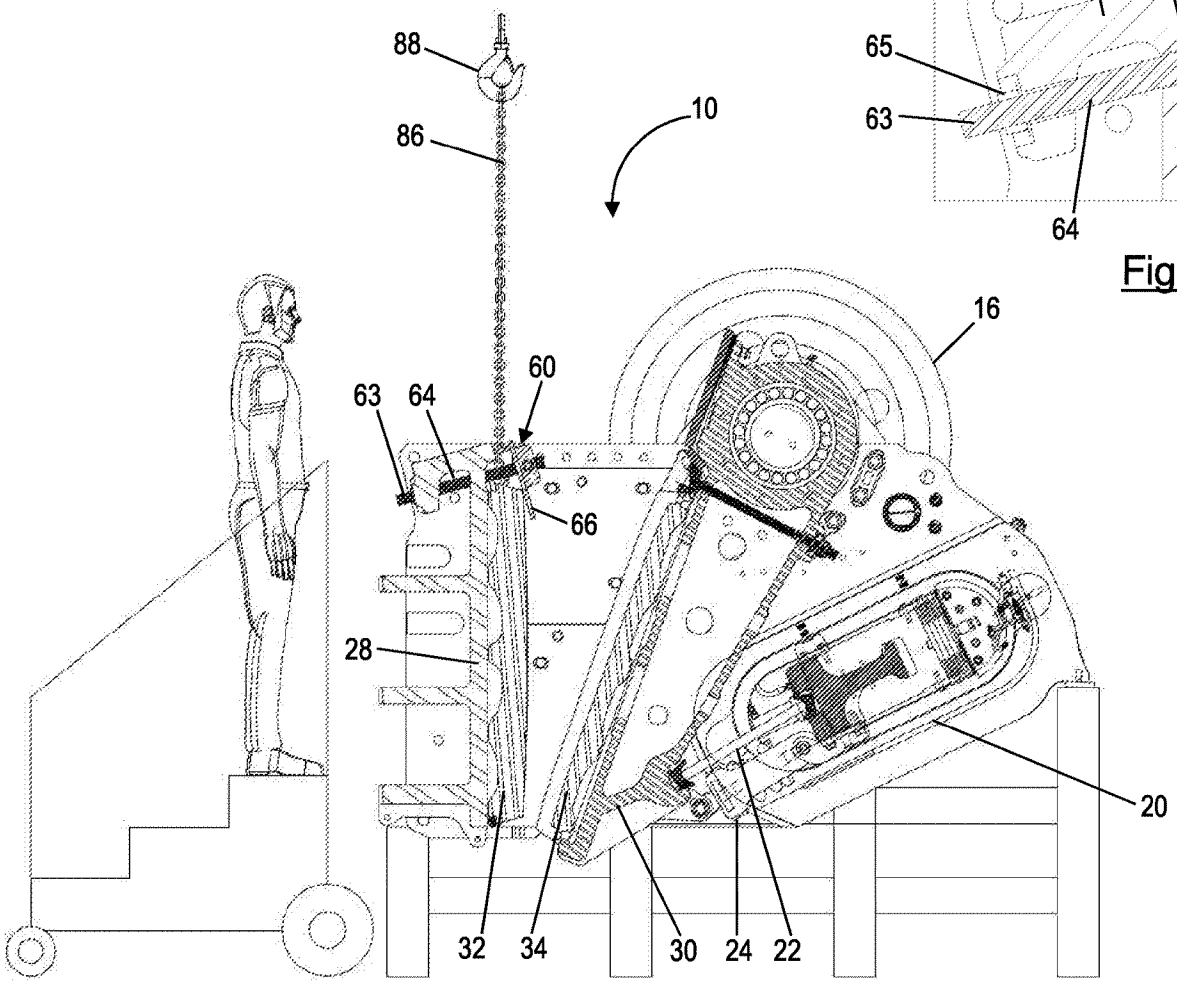
FIG. 4 is a side view of the jaw crusher of FIG. 1.
Figure 6:
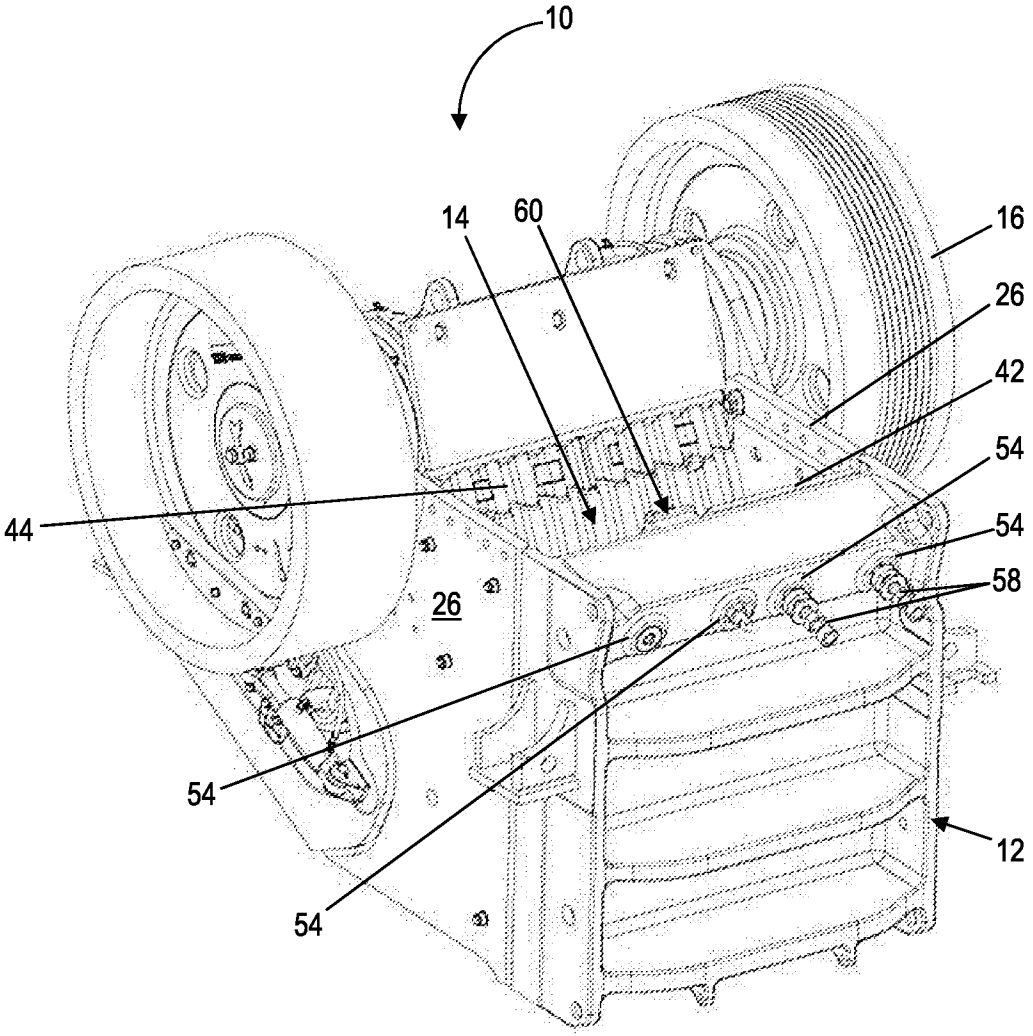
FIG. 6 is an alternative perspective view of the jaw crusher of FIG. 1.

As can best be seen from FIG. 5, when the clamping tool 60 is in place, the clamping head 62 engages with the jawstock 28 and with the jaw liner 32. The fastener 65 tensions the shaft 64 with respect to the jawstock 28 to create a clamping force by which the clamping head 62 clamps the jaw liner 32 to the jawstock 28. The clamping surface 70 of the first clamping portion 66 engages with the crushing surface 36, advantageously extending across and engaging with at least two adjacent ridges 40 (preferably with the respective crest of each ridge 40). In preferred embodiments, the clamping surface 70 engages with an edge or corner (in this case the top edge or corner 37) of the crushing surface 36. The clamping surface 72 of the second clamping portion 68 engages with the jawstock 28, preferably with a portion 90 of the jawstock 28 adjacent the recess 46 (typically beyond the recess 46 with respect to the liner 32). Hence, in the preferred embodiment, the clamping head 62 extends across the recess 46, with the shaft 64 extending through a socket that opens into the recess 46. In preferred embodiments engagement of the clamping surface 72 of the second clamping portion 68 the jawstock 28 helps to align the clamping surface 70 of the first clamping portion 66 with the surface 36 of the jaw liner 32, thereby facilitating good contact between the surfaces 36, 70. In alternative embodiments, the second clamping portion may be omitted.

Advantageously, the pivoting capability of the clamping head 62 allows the clamping head 62 to pivot into an optimum clamping position that allows it to accommodate different types of jaw liner 32 (for example liners having different crushing surfaces, e.g. differently shaped and/or dimensioned ridges 40, and/or crushing surfaces/ridges that may be new or worn). Moreover, the width of the first clamping portion 66 allows it to provide a stable engagement with the crushing surface 36, including those of different types of jaw liner 32 (for example liners having different crushing surfaces, e.g. differently shaped and/or dimensioned ridges 40, and/or crushing surfaces/ridges that may be new or worn).

Figure 7:
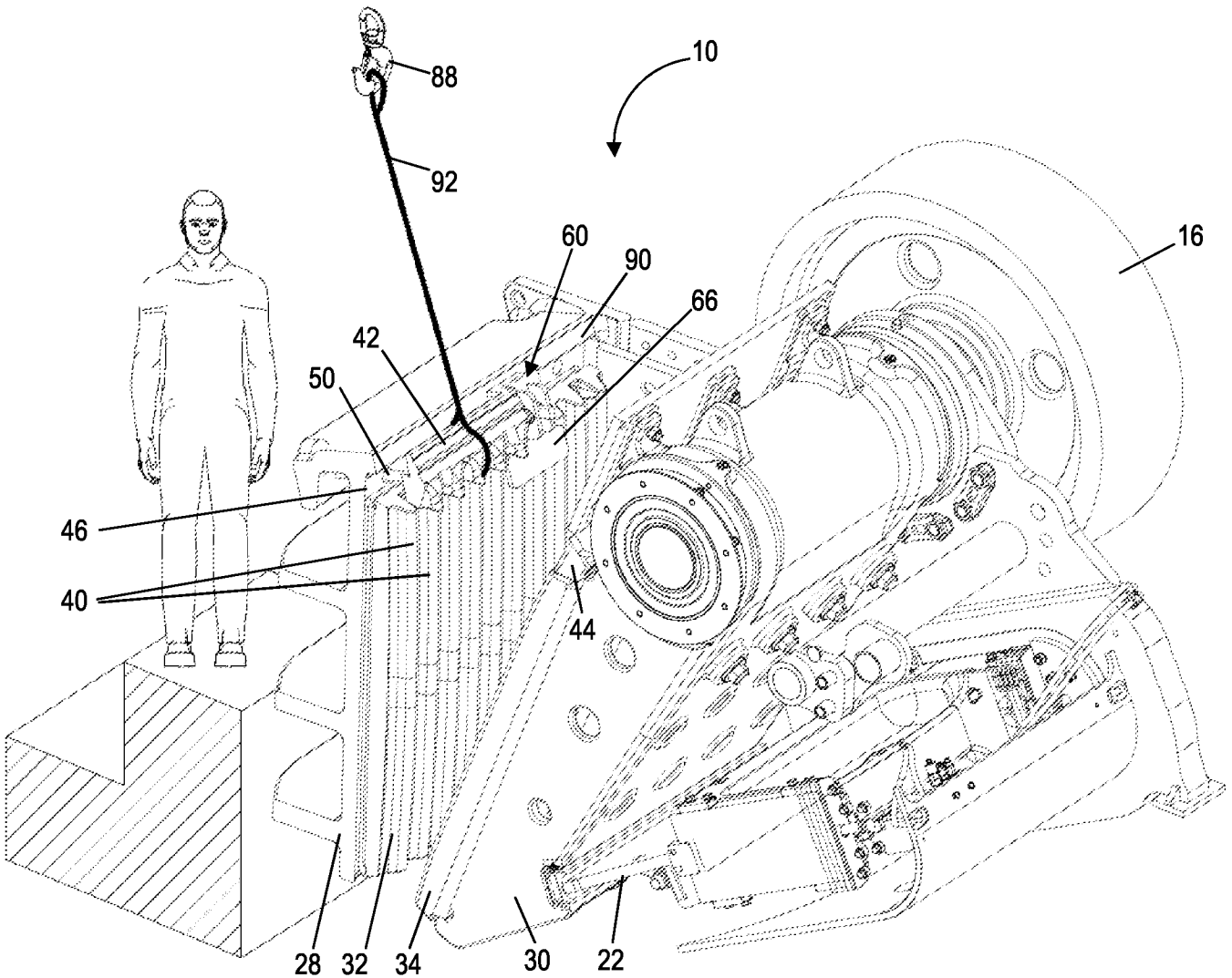
FIG. 7 is a perspective view of the jaw crusher of FIG. 3 showing a wedge being fitted.

When the clamping tool 60 is secured in place, the lifting equipment can be disconnected from the jaw liner 32. The first locking wedge 42 may then be fitted while the clamping tool 62 holds the liner 32 in place. Typically this involves the use of mechanical lifting equipment (e.g. a hoist or crane), which is represented in FIG. 7 by chain 92 and hook 88. Once the first locking wedge 42 is secured in place, the clamping tool 62 is removed to allow the second locking wedge (not shown) to be fitted.

The invention is not limited to the embodiment(s) described herein but can be amended or modified without departing from the scope of the present invention.

The invention claimed is:

1. A jaw crusher assembly comprising:

a jaw crusher having first and second jaws, at least one of said jaws having a jaw liner, said jaw liner having a crushing surface; and a jaw liner clamping tool comprising:

a shaft;

a clamping head coupled to the shaft, the clamping head comprising a first clamping portion having a clamping surface; and a releasable fastening mechanism, wherein said clamping tool is coupled to said at least one jaw by said shaft and said fastening mechanism, with said clamping surface engaging said crushing surface of said jaw liner to releasably clamp said jaw liner to said at least one jaw.

2. The jaw crusher of claim 1, wherein said clamping surface engages with an edge of said crushing surface.

3. The jaw crusher of claim 1, wherein said crushing surface comprises a plurality of parallel ridges, the clamping surface of said first clamping portion being shaped and dimensioned to engage with at least two of said ridges.

4. The jaw crusher of claim 1, wherein said shaft projects from an underside of said clamping head, said clamping surface being provided on the underside of said clamping head.

5. The jaw crusher of claim 1, wherein said clamping head comprises a plate.

6. The jaw crusher of claim 1, wherein said clamping head comprises a second clamping portion having a clamping surface engaging with the jaw to which said jaw liner is fitted, said shaft being located between said first and second clamping portions.

7. The jaw crusher of claim 6, wherein said clamping surface of said second portion is provided by a flange projecting from an underside of said clamping head.

8. The jaw crusher of claim 1, wherein said clamping head is pivotably coupled to the shaft for pivoting movement about a pivot axis, and wherein said clamping head comprises first and second clamping portions on opposite sides of the pivot axis.

9. The jaw crusher of claim 8, wherein said shaft passes through a slot formed in the clamping head, and is coupled to said clamping head by a pivot joint.

10. The jaw crusher of claim 1, wherein said fastening mechanism is adjustable to allow the clamping tool to be tightened to exert a clamping force.

11. The jaw crusher of claim 1, wherein said at least one of said first and second jaws comprises a jawstock to which said jaw liner is fitted, said clamping tool engaging with said jawstock and said jaw liner to clamp said jaw liner to said jawstock.

12. The jaw crusher of claim 11, wherein said clamping head comprises a second clamping portion, said second clamping portion has a clamping surface in engagement with said jawstock.

13. The jaw crusher of claim 11, wherein a wedge-receiving recess is defined between an end of said jaw liner and a portion of said jawstock, said clamping head extending over said recess.

14. The jaw crusher of claim 11, wherein said jawstock includes at least one socket, said shaft of said clamping tool being inserted in one of said at least one socket.

15. The jaw crusher of claim 14, wherein a wedge-receiving recess is defined between an end of said jaw liner and a portion of said jawstock, said clamping head extending over said recess, and wherein said at least one socket opens onto said recess.

16. The jaw crusher of claim 14, wherein a free end of said shaft projects from said socket, and wherein said fastening mechanism fastens said free end of said shaft to said jawstock.

17. The jaw crushing assembly of claim 1, wherein said crushing surface is a ridged crushing surface, and said clamping surface has a width that is at least equal to the pitch between adjacent ridges of the crushing surface.

18. The jaw crusher assembly of claim 3, wherein the clamping surface of said first clamping portion engages with a respective crest of said at least two ridges.

19. The jaw crusher assembly of claim 6, wherein said clamping surface of said second clamping portion is provided on an underside of said clamping head.

* * * * *